US005125646A

United States Patent [19]

Wilkinson

[11] Patent Number: 5,125,646

[45] Date of Patent: Jun. 30, 1992

[54] AEROBIC STEP/BENCH EXERCISE DEVICE

[76] Inventor: William T. Wilkinson, P.O. Box 378, Chesapeake City, Md. 21915

[21] Appl. No.: 695,394

[22] Filed: May 3, 1991

[51] Int. Cl.[5] ..... A63B 5/00

[52] U.S. Cl. ..... 482/52; 248/188.2; 248/911; 108/144; 403/3

[58] Field of Search ..... 248/188.2, 649, 911; 108/11, 12, 144, 111; 403/3; 272/70, 144, DIG. 4

[56] References Cited

U.S. PATENT DOCUMENTS

| | | | |
|---|---|---|---|
| 314,831 | 3/1885 | Hardy | 108/144 |
| 2,605,987 | 8/1952 | Brown et al. | 108/144 |
| 3,245,365 | 4/1966 | Doherty | 108/144 |
| 3,586,306 | 6/1971 | Reece | 248/188.2 X |
| 3,604,371 | 9/1971 | Cavalucci | 108/156 |
| 3,865,050 | 2/1975 | Cecchetti | 108/19 |
| 4,615,279 | 10/1986 | De la Haye | 108/144 |

*Primary Examiner*—Cary E. O'Connor
*Assistant Examiner*—L. Thomas
*Attorney, Agent, or Firm*—Connolly & Hutz

[57] ABSTRACT

An aerobic step/bench exercise device includes a base having a horizontal platform with downwardly extending sides. The lower surface of the base includes a plurality of spaced leg receiving openings. Each of the openings has at least one notch extending upwardly from the lower surface into which a lateral projection from a respective leg would be inserted to control the extent to which a leg may be inserted into its respective opening.

20 Claims, 4 Drawing Sheets

AEROBIC STEP/BENCH EXERCISE DEVICE

BACKGROUND OF INVENTION

Various devices exist for use in an aerobic exercise program. One type of device which has met with great success is a bench or step for aerobic step climbing. For example, I have developed a form of single step climbing during which the user would repeatedly step up and down from a single step. An important feature for making the device capable of wide spread appeal to permit it to be customized to the needs of the particular user is height adjustability. In my U.S. Pat. No. 4,340,218 I disclosed one manner of achieving this height adjustability. Later patents and applications of mine disclose useful variations for accomplishing that result.

SUMMARY OF THE INVENTION

An object of this invention is to provide an exercise device for simulating climbing which is compact and lightweight and capable of being conveniently stored and transported.

A further object of this invention is to provide such a device which may offer a wide variety of incremental heights which are easily and quickly adjustable to accommodate the needs of the particular user.

A still further object of this invention is to provide an unobstructed platform surface so that the user can safely step on and off in any direction.

A still further object is to provide such a device which may be mass produced relatively inexpensively in a simple design.

In accordance with this invention, the aerobic step/-bench exercise device comprises a base having a horizontal platform with downwardly extending sides. The lower surface of the base includes a plurality of spaced leg receiving openings which extend upwardly. Each of the openings has at least one notch into which a lateral projection of its leg would fit to control the amount to which the leg could be telescoped into the opening. As a result, the exercise device is capable of multiple elevations, one of which would be when the base itself is mounted directly on a support surface and another elevation would result from legs being mounted to the base.

In a preferred practice of this invention, multiple sets of notches having different vertical extensions are provided for each opening to provide incremental height adjustments. Preferably each set includes at least two notches for receiving two lateral projections of its respective leg.

The device may be used in conjunction with a mat which is capable of being folded to double its height. Accordingly, the height variations could include the lowest height where the unfolded mat is used as a step with the next height being the folded mat. Further variations would include the base itself being mounted directly on the support platform. Additional heights would be determined by which of the notches in the base are used when the legs are mounted to the base and the highest height would be achieved when the base with its legs are placed on top of the mat.

The invention may be practiced by forming the base with its downwardly extending sides in the form of an apron so that a space is created within the periphery of the apron. The legs and mat may be mounted in the space within the apron periphery during period of non-use.

THE DRAWINGS

DETAILED DESCRIPTION

Figure 1:
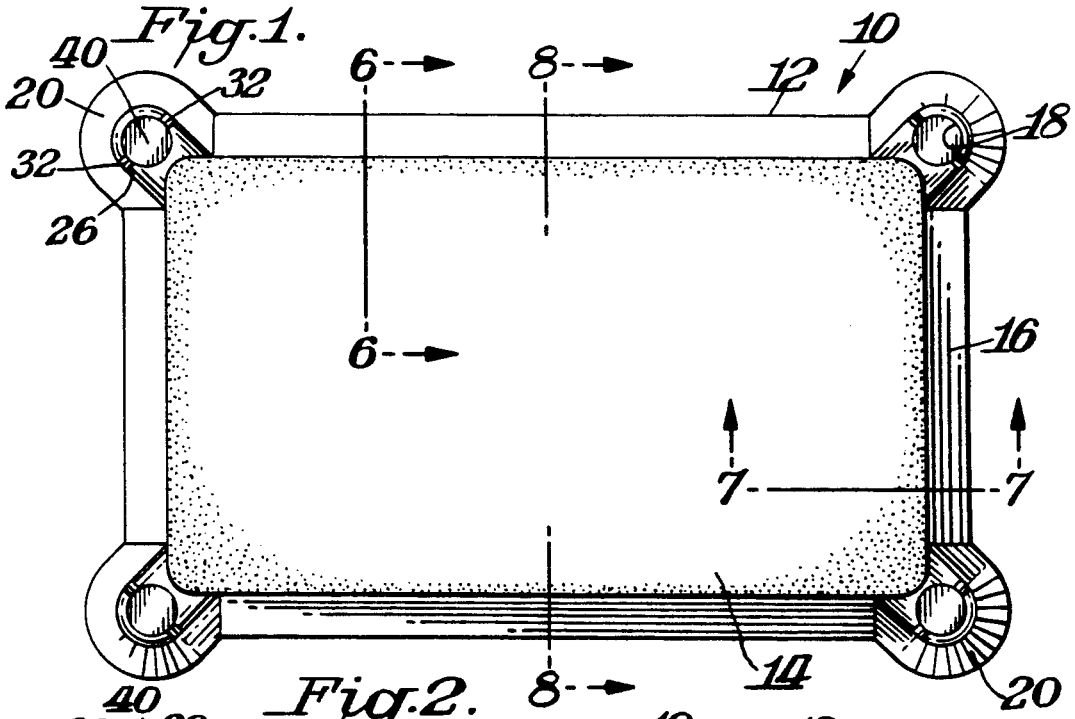
FIG. 1 is a top plan view of an aerobic step/bench exercise device in accordance with this invention.
Figure 2:
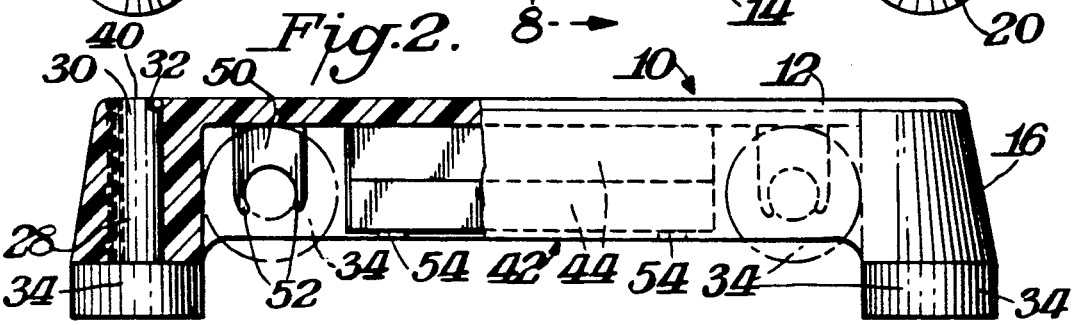
FIG. 2 is a side elevational view partly in section of the device shown in FIG. 1.
Figure 3:
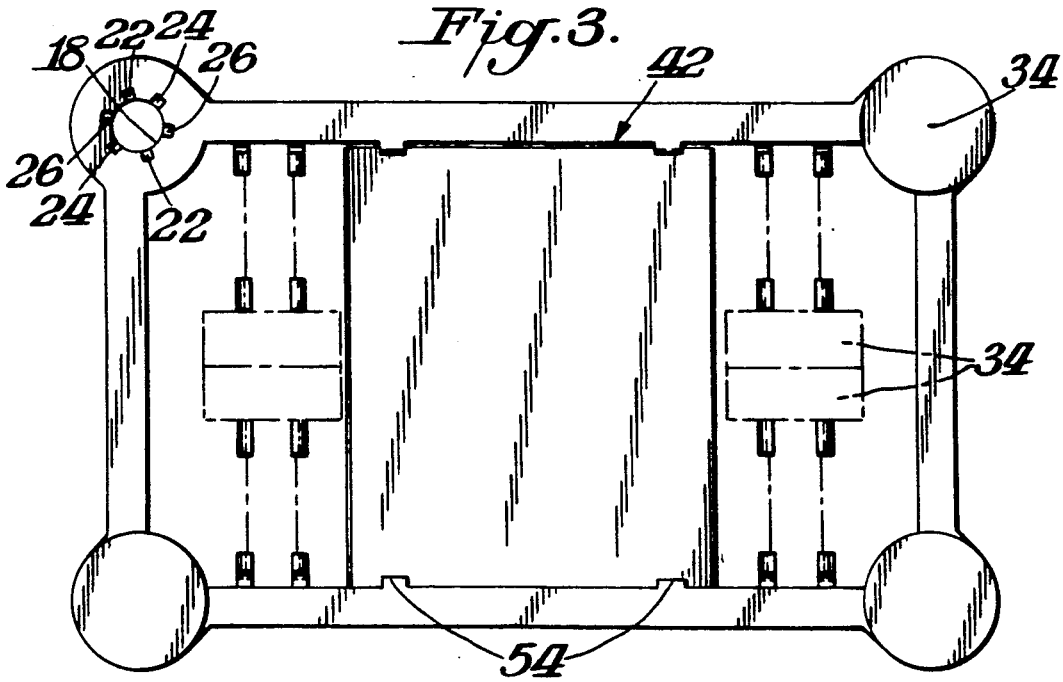
FIG. 3 is a bottom plan view of the device shown in FIG. 1 with legs mounted at three of the corners.

FIGS. 1–3 illustrate an aerobic step/bench exercise device 10 in accordance with this invention. As shown therein device 10 includes a base 12 which is in the form of a horizontal platform 14 having downwardly extending sides 16. The base may be in the form of a solid block. In the preferred practice of the invention, however, the downwardly extending sides 16 are a peripheral apron so that a space is created within the periphery of apron 16. This space advantageously facilitates the base 12 being made of lightweight form, facilitates the manufacturing procedures by making the base capable of being extruded plastic and also provides a space for storage purposes as later described. It is to be understood that while the figures illustrate apron 16 to be a continuous closed apron the invention may be practiced where spaces are provided in apron 16 in which case the apron would actually comprise spaced downward extensions at various locations from platform 14.

Figure 13:
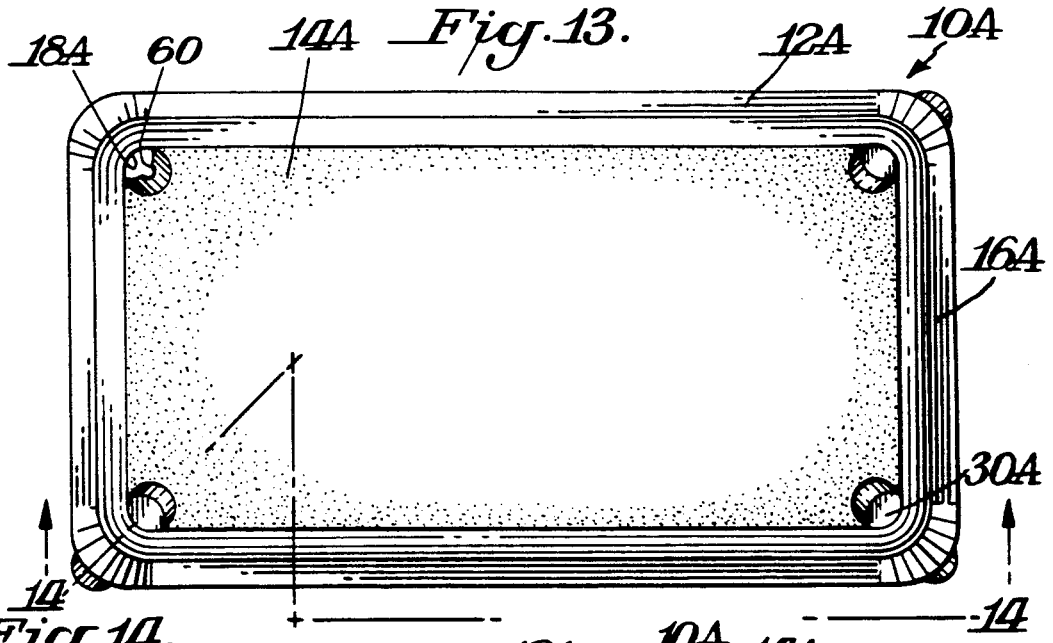
FIG. 13 is a top plan view of a modified form of device in accordance with this invention.

Platform 14 may be of square or rectangular shape as illustrated in FIG. 13 or may have outward projections at each of its corners as illustrated in FIG. 1. The invention may also be practiced with platform 14 taking any other desirable shape including a circular or oval shape.

In accordance with this invention a plurality of leg receiving openings 18 is provided at spaced locations along base 12. In the preferred practice of the invention the extended corners 20 of base 12 include solid areas into which the openings 18 are formed. Such solid areas may be provided at any suitable spaced locations of base 12 and function to permit the openings to extend upwardly from the lower surface of base 12 any suitable distance including the entire height of base 12. Thus, the openings 18 may extend completely through base 12 and may be visible from the top or may extend a distance slightly short of the top surface of platform 14.

Where openings 18 extend completely through base 12, if desired the openings may be covered by a cap or other suitable structure. For example, where platform 14 is provided with a non-skid surface the thickness afforded by the non-skid surface may be utilized to accommodate a cap which covers each opening 18. All support contacting surfaces (i.e. the lower edge of base 12 and the bottom of the legs) preferably have a non-slip surface. In the preferred practice of the invention the upper surface of platform 14 is completely flat and planar so as to avoid any obstructions which might cause the user to trip.

A characterizing feature of the invention is that each opening 18 includes at least one notch which extends laterally outwardly from the opening over a vertical distance from the lower surface 38 of base 12. FIG. 3 illustrates the preferred practice of the invention wherein there are three sets of notches 22, 24, 26. Each set in turn includes two radially aligned notches. To be understood, however, that the invention may be practiced with more or less than three sets and that each set may include more or less than two notches.

In accordance with this invention, the notches are utilized to provide height adjustability for platform 14. This is done by providing a leg 28 for each opening 18. Leg 28 includes a portion 30 dimensioned for telescoping into opening 18 to be snugly received therein. In the preferred practice of the invention, the openings 18 are of circular cross-section and the extensions 30 are likewise of circular cross-section. Where openings 18 have different cross-sections such as squares, ovals, etc. the extensions 30 would be complementary shaped. Each leg 28 includes an outwardly extending projection 32 for fitting in the various notches. Thus, in the illustrated embodiment where each set of notches includes two notches there would be a corresponding number of lateral projections 32.

The various sets of notches differ from each other in the extent to which each set of notches extends upwardly from the lower surface 38 of base 12. For example, notches 22,22 are dimensioned to extend a short distance from the lower surface 38 of base 12 while notches 24,24 extend an intermediate distance and notches 26,26 extend the full length of opening 18. Where notches are provided which extend the full length of opening 18 it is necessary to provide some abutment which limits the extent of telescoping of leg 28 so that the upper edge of the leg does not extend beyond the upper surface of platform 18 and so that there is a fixed length below lower surface 38. In the embodiment shown in FIGS. 2, 4 and 5 the abutment is provided by having an enlarged foot 34 connected to the lower end of extension 30. The upper surface 36 of foot 34 would contact the lower surface 38 of base 16 when projections 32 are inserted into notches 26,26 so that the upper face 40 of leg 28 would be flush with the upper surface of platform 14 when projections 32 are in notches 26,26. When notches 22,22 or 24,24 are used the abutting surfaces are the projections 32 abutting the upper edge of the notches.

Figure 9:
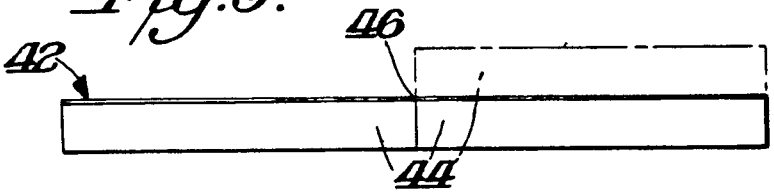
FIG. 9 is a side elevational view of a warm-up mat usable with the device of FIGS. 1–8.
Figure 10:
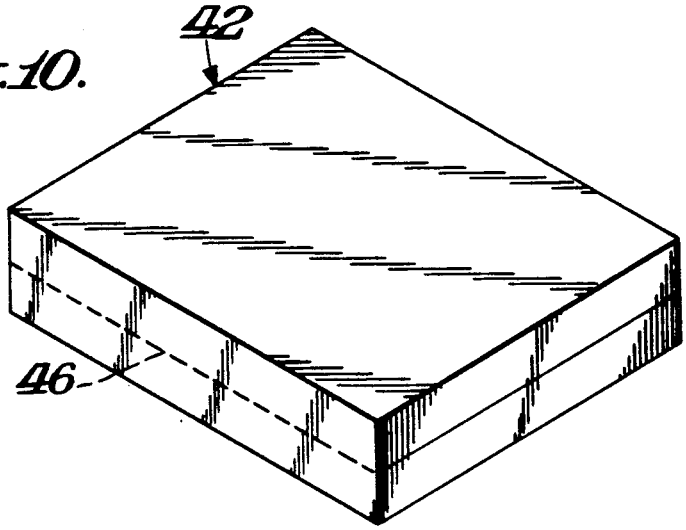
FIG. 10 is a perspective view of the mat shown in FIG. 9 in its folded condition.

In accordance with a further feature of this invention a warm-up mat 42 is provided as illustrated in FIGS. 9–10. Warm-up mat 42 may be made of any suitable material such as a foam material and is constructed to be in the form of two panels 44,44 hinged together by a flexible hinge 46 along their common side. Thus, mat 42 may be disposed in one of two conditions. FIG. 9 illustrates one condition of mat 42 where the panels 44,44 are side by side. FIG. 10 and FIG. 9 in phantom illustrates an alternative position where the panels are folded so that one panel is disposed on top of the other which would double the height of mat 42. When mat 42 is in its unfolded condition, its surface is larger than base 12 whereby base 12 and legs 28 may be placed on mat 42.

Figure 4:
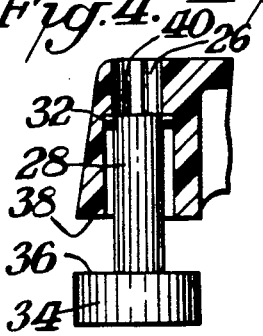
FIGS. 4–5 are side elevational views partly in section showing different leg mounting positions.

As will be later described device 10 especially in conjunction with mat 42 provides a number of height adjustments ranging from the lowest height where mat 42 is used alone in its unfolded condition shown in FIG. 9 to a maximum height where legs 28 are mounted in base 12 and the device 10 is then placed on top of mat 42. In the preferred practice of this invention the various components are dimensioned to provide two inch increment height adjustments. In this respect each panel 44 of mat 42 would be two inches thick which would be the lowest height for the step or would permit the mat to function as a warmup mat. When mat 42 is folded as shown in phantom in FIG. 9 and as shown in FIG. 10 the folded mat 42 would be four inches high. Base 12 is dimensioned so that the upper surface of platform 14 extends above the lower surface 38 of base 12 by a distance of four inches. Notches 22,22 extend two inches above lower surface 38. Notches 24,24 extend four inches above lower surface 38 and notches 26,26 extend the full six inches above lower surface 38. Accordingly, a step two inches high may be provided when mat 42 in its unfolded condition is used as the step. A step four inches high would result when mat 42 is folded to the position shown in FIG. 10 and shown in phantom in FIG. 9. A step six inches high would result when base 12 is placed directly on the floor or other support surface. A step eight inches high would result when projections 32 are inserted in notches 26,26 as shown in FIG. 2 with the extra two inches height being achieved by foot 34 being made two inches high. A step ten inches high would be achieved by inserting projections 32,32 into notches 24,24 as shown in FIG. 4. A step twelve inches high would result when projections 32,32 are inserted into notches 22,22 as shown in FIG. 5 and a step fourteen inches high would result when device 10 is mounted on unfolded mat 42 while its legs 28 are in the position shown in FIG. 5.

Figure 5:
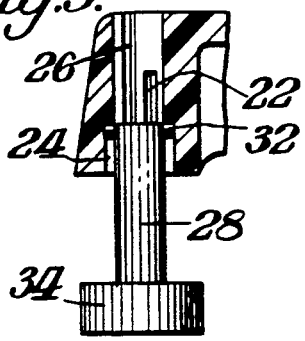
Figure 6:
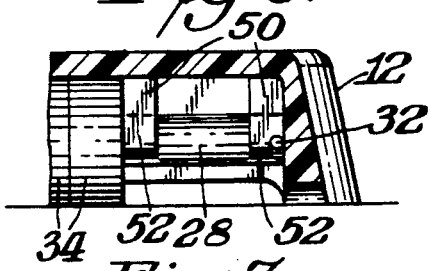
FIGS. 6–8 are cross-sectional views taken through FIG. 1 along the lines 6—6, 7—7 and 8—8, respectively.
Figure 7:
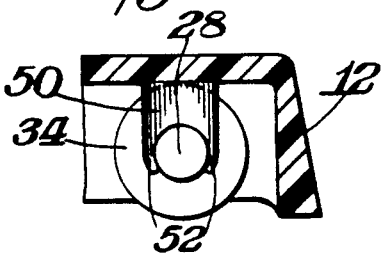

Although FIGS. 2, 4 and 5 illustrate a particularly desirable embodiment for legs 28, the invention may be practiced wherein legs 28 have other shapes. For example, FIG. 1 illustrates a modified leg 28A which has a generally flat foot 34A. In order to prevent extensions 30 from projecting beyond the upper surface of platform 14 when projections 32 are inserted into notches 26, an abutment is provided in the form of a collar 48 which would have an abutment surface 36A. Alternatively, the collar and its abutment surface could be omitted if platform 14 itself is provided with some form of stop member, such as a cap, web or other projection at least partially across the upper portion of opening 18.

Figure 12:
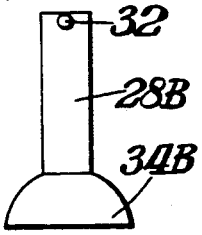

FIG. 12 shows a further modified leg 28B wherein a dome shaped foot 34B is provided. The tapered domed surface would provide the abutment at the entrance to opening 18.

A further feature of this invention is the capability of base 12 to store the legs and mat during periods of non-use. FIGS. 2–3[1] and 6–7 illustrate the structure for storing four legs. In the illustrated embodiment the legs take the form of legs 28. The same concepts, however, could be utilized for other forms of legs. As illustrated therein spaced brackets 50 extend downwardly from the lower surface of platform 14. Brackets 50 terminate in spring fingers 52 which may be deflected outwardly to permit the narrow extension 30 of each to pass therebetween and then return to their original condition for securely holding a set of legs in end to end relationship at opposite ends within the periphery of apron 16.

Figure 8:
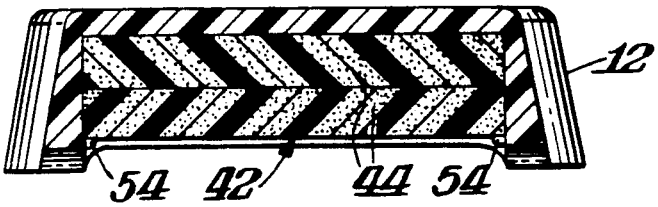
Figure 11:
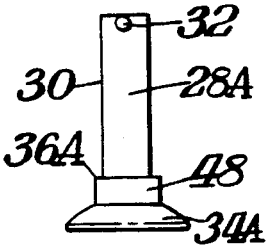
FIGS. 11–12 are side elevational views of modified forms of legs useable with the device of FIGS. 1–8.

The lower surface of apron 16 is also provided with spaced spring fingers 54 which project inwardly as shown in FIGS. 2-3 and 8. Spring fingers 54 are utilized to hold mat 42 in its folded condition against the lower surface of platform 14. FIG. 8, for example, illustrates the folded mat 42 to be inserted in the space at the central portion of the periphery of apron 16 by passing the mat over the spring fingers 54 and then having the spring fingers 54 extend a sufficient distance inwardly to hold the mat in place. Although fingers 54 are preferably spring fingers the fingers or projections need not be flexible o springy since the flexibility of the mat material itself would provide sufficient give to permit the mat to pass over fingers 54.

Figure 14:
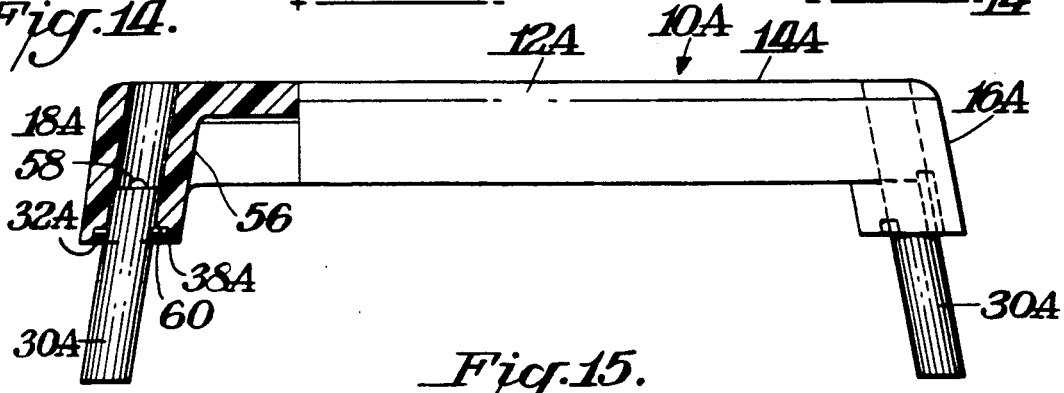
FIG. 14 is a cross-sectional view taken through FIG. 13 along the line 14—14.
Figure 15:
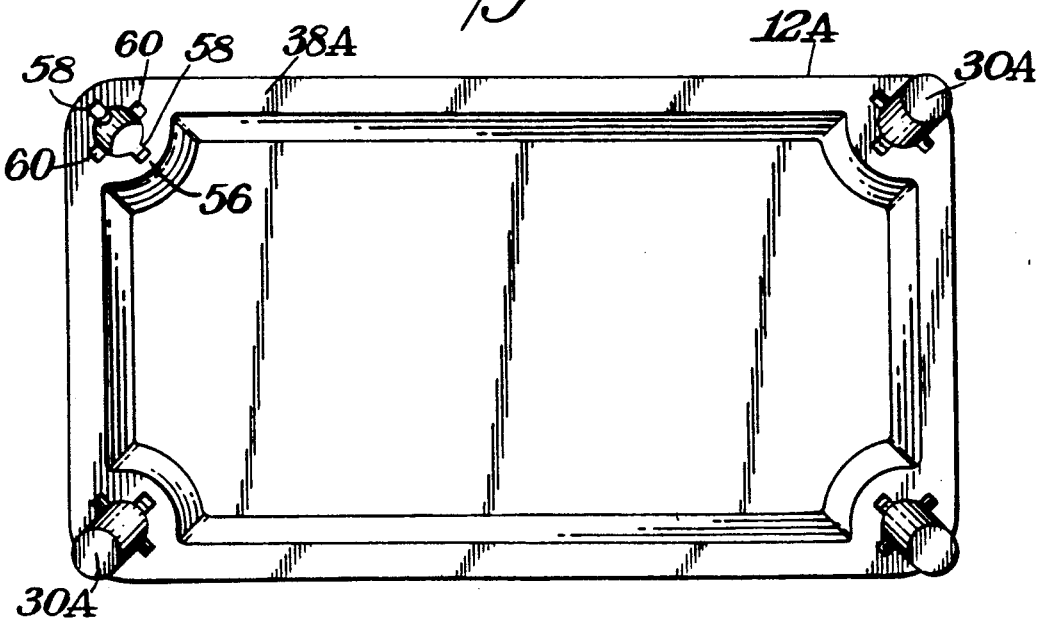
FIG. 15 is a bottom plan view of the device shown in FIGS. 13–14 with legs inserted in three of the corners.
Figure 16:
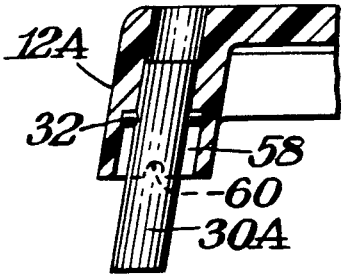
FIGS. 16–17 are side elevational views partly in section showing different mounting positions for the leg used with the device of FIGS. 13–15.
Figure 17:
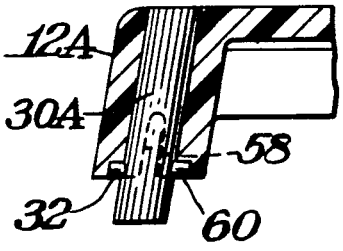
Figure 18:
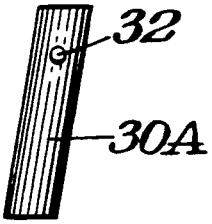
FIG. 18 is a side elevational view of the leg used in the device of FIGS. 13–17.

FIGS. 13-15 illustrate a modified device 10A which incorporates the same height adjustment principles a device 10. In the exercise device 10A openings 18A are inclined with an apron 16A of base 124 having inclined inner surfaces in the location of each opening 18A. The inner surfaces are indicated by the reference numeral 56 in FIGS. 14-15. As previously indicated the invention is not limited to providing three sets of notches. Thus, device 10A is shown as having two sets of notches formed by one set of notches 58,58 and an intermediate set of notches 60,60. Notches 58,58 extend only a slight distance above the lower surface 38A sufficient to accommodate projections 32A. Intermediate notches 60,60 extend a further distance so that legs 30A may be telescoped further into openings 18A. As previously noted device 10A differs from device 10 in that platform 14 has a generally rectangular shape rather than having outward extensions at each corner.

Although not illustrated it is to be understood that base 12A of device 10A could include suitable brackets connected to the lower surface of platform 14A similar to brackets 50 and fingers extending inwardly from apron 16A similar to fingers 54 for holding the legs and mat.

As can be appreciated the present invention thus provides an advantageous manner of providing height adjustability so that a step will result capable of height adjustment over a large variety of different heights. Although the invention has been described wherein the height adjustment is in two inch increments in the range of two inches to fourteen inches the invention may be practiced with other increments and other ranges.

What is claimed is:

1. An aerobic step/bench exercise device comprising a base, said base having a horizontal platform with downwardly extending sides, said basing having a lower surface remote from said platform, a plurality of spaced leg receiving openings in said base extending upwardly from said lower surface, each of said openings having at least one notch at said lower surface extending laterally outwardly from said opening over a fixed vertical distance from said lower surface, at least two legs, each of said legs being insertable into a respective one of said openings, each of said legs having an outwardly extending fixedly mounted projection for fitting in said notch of said respective opening to detachably mount said leg to said base, each of said legs and said base having abutting surfaces to limit the extent each of said legs may be telescoped into said respective opening, an abutting surface covering said notch at said fixed vertical distance to comprise said abutting surface of said base, and said outwardly extending projection comprising said abutting surface of said leg whereby said platform is capable of being disposed at a plurality of elevations wherein one of said elevations results from said base being mounted directly on a support surface when said legs are detached from said base and another of said elevations results from said legs being mounted to said base with said abutting surfaces contacting each other.

2. An aerobic step/bench exercise device comprising a base, said base having a horizontal platform with downwardly extending sides, said base having a lower surface remote from said platform, a plurality of spaced leg receiving openings in said base extending upwardly from said lower surface, each of said openings having at least one notch at said lower surface extending laterally outwardly from said opening over a vertical distance from said lower surface, at least two legs, each of said legs being insertable into a respective one of said openings, each of said legs having an outwardly extending projection for fitting in said notch of said respective opening to detachably mount said leg to said base, each of said legs and said base having abutting surfaces to limit the extent each of said legs may be telescoped into said respective opening whereby said platform is capable of being disposed at a plurality of elevations wherein one of said elevations results from said base being mounted directly on a support surface when said legs are detached from said base and another of said elevations results from said legs being mounted to said base, a plurality of sets of said notches extending from said lower surface, and each of said sets of notches extending different vertical distances from said lower surfaces.

3. The device of claim 2 wherein each of said sets of notches includes more than one notch, and each of said legs having a plurality of projections corresponding to the number of notches in each of said sets.

4. The device of claim 3 wherein one of said sets of notches extends from said lower surface to the upper surface of said platform, and said leg having an abutting surface for contacting said lower surface of said base when said projections are in said set of notches which extends to said upper surface of said platform for limiting the telescoping distance of said leg into said opening.

5. The device of claim 3 wherein an apron extends downwardly from said platform to comprise said downwardly extending sides, and an open space being created within the periphery of said apron.

6. The device of claim 5 including mounting brackets extending from the lower side of said platform into said space within the periphery of said apron for holding said legs when said legs are in their non-use and storage condition.

7. The device of claim 6 including a mat, said mat having an area larger than the peripheral area formed by said base when said legs are mounted to said base whereby said base may be mounted over said mat with said legs supported by said mat.

8. The device of claim 7 wherein said mat is formed by a pair of panels hinged together so that one panel may be folded on top of other of said panels.

9. The device of claim 8 including projections extending from the lower surface of said apron for mounting said mat in said space within the periphery of said apron when said mat is in its folded condition during periods of non-use.

10. The device of claim 9 wherein said device and said apron are capable of providing a step having a height in the range of two inches to fourteen inches with said mat in its unfolded condition comprising said step at said two inch height and said base and said legs being mounted on said mat when said step is in its fourteen inch height.

11. The device of claim 4 wherein said legs are mounted perpendicular to said platform.

12. The device of claim 4 wherein said legs are mounted at an obtuse angle to said platform.

13. The device of claim 4 wherein each of said legs terminates at its lower end in a dome shaped foot.

14. The device of claim 4 wherein each of said legs terminates at its lower end in a flattened foot.

15. The device of claim 1 wherein a plurality of sets of said notches extend from said lower surface, each of said sets of notches extending different vertical distances from said lower surfaces.

16. The device of claim 15 wherein each of said sets of notches includes more than one notch, and each of said legs having a plurality of projections corresponding to the number of notches in each of said sets.

17. The device of claim 15 wherein one of said sets of notches extends from said lower surface to the upper surface of said platform, and said leg having an abutting surface for contacting said lower surface of said base when said projections are in said set of notches which extends to said upper surface of said platform for limiting the telescoping distance of said leg into said opening.

18. The device of claim 17 wherein an apron extends downwardly from said platform to comprise said downwardly extending sides, and an open space being created within the periphery of said apron, and mounting brackets extending from the lower side of said platform into said space within the periphery of said apron for holding said legs when said legs are in their non-use and storage condition.

19. The device of claim 18 including a mat, said mat having an area larger than the peripheral area formed by said base when said legs are mounted to said base whereby said base may be mounted over said mat with said legs supported by said mat.

20. The device of claim 19 wherein said mat is formed by a pair of panels hinged together so that one panel may be folded on top of other of said panels, and projections extending from the lower surface of said apron for mounting said mat in said space within the periphery of said apron when said mat is in its folded condition during periods of non-use.

* * * * *